US007849698B2

(12) United States Patent
Harrod et al.

(10) Patent No.: US 7,849,698 B2
(45) Date of Patent: Dec. 14, 2010

(54) METHOD AND APPARATUS TO SENSE AND ESTABLISH OPERATION MODE FOR AN HVAC CONTROL

(75) Inventors: Gregory R. Harrod, Wichita, KS (US); Jeffrey L. Tucker, Wichita, KS (US)

(73) Assignee: York International Corporation, York, PA (US)

( * ) Notice: Subject to any disclaimer, the term of this patent is extended or adjusted under 35 U.S.C. 154(b) by 1194 days.

(21) Appl. No.: 11/337,727

(22) Filed: Jan. 23, 2006

(65) Prior Publication Data

US 2006/0196200 A1 Sep. 7, 2006

Related U.S. Application Data

(60) Provisional application No. 60/657,937, filed on Mar. 2, 2005.

(51) Int. Cl.
*F25B 49/00* (2006.01)
*F25B 29/00* (2006.01)

(52) U.S. Cl. ..... 62/127; 62/129; 62/159; 62/160; 62/208; 62/213; 62/324.1; 236/94; 700/276

(58) Field of Classification Search ..... 62/127, 62/129, 159, 160, 208, 213, 324.1; 236/94; 700/276, 278

See application file for complete search history.

(56) References Cited

U.S. PATENT DOCUMENTS 3,127,930 A * 4/1964 Tenniswood ..... 62/324.1
4,503,686 A 3/1985 Moizumi
4,702,305 A 10/1987 Beckey et al.
4,941,325 A 7/1990 Nuding
5,039,009 A 8/1991 Baldwin et al.
5,161,606 A 11/1992 Berkeley et al.
5,379,606 A 1/1995 Katsuki et al.
5,622,310 A 4/1997 Meyer
5,628,199 A 5/1997 Hoglund et al.
6,169,937 B1 * 1/2001 Peterson ..... 700/276
6,205,797 B1 3/2001 Maeda
6,220,043 B1 4/2001 Chaney, Jr. et al.
6,606,871 B2 8/2003 Butcher et al.
7,562,536 B2 * 7/2009 Harrod et al. ..... 62/228.1

* cited by examiner

*Primary Examiner*—Frantz F Jules
*Assistant Examiner*—Daniel C Comings
(74) *Attorney, Agent, or Firm*—McNees Wallace & Nurick LLC

(57) ABSTRACT

A method for configuring a controller for an HVAC system. The method comprises providing a closed loop refrigerant system and a control system to control the closed loop refrigerant system. The control system comprises a controller, an input device, and a processor including a signal sensing circuit. The input device is activated to provide one or more signals to the controller to control the components of the closed loop refrigerant system. One or more signals are sensed with the signal sensing circuit to determine whether signals are present between the input device and the controller. The signals are processed with the processor to determine what type of closed loop refrigerant system is present. The controller is then configured to control the type of system determined by the processor.

17 Claims, 11 Drawing Sheets

METHOD AND APPARATUS TO SENSE AND ESTABLISH OPERATION MODE FOR AN HVAC CONTROL

FIELD OF THE INVENTION

The present invention is directed to heating, ventilation and air conditioning (HVAC) systems. In particular, the present invention is directed to methods and systems that automatically sense operational modes for HVAC controllers.

BACKGROUND OF THE INVENTION

HVAC controllers are used to control the various components of the HVAC or refrigerant system. The controller uses inputs, typically from a thermostat, to determine how the system should be controlled. The thermostat reads temperature and has temperature set points. Based upon the temperatures read by the thermostat and the set points, the thermostat sends signals to the controller which tell the controller how to control the system. For example, a thermostat may sense a temperature reading that is above the set point temperature and in response, the thermostat will provide the controllers within the system with signals that cause the indoor blower to operate and cause the refrigerant circuit to run the system in an air conditioning mode to lower the temperature of the air to the set point.

HVAC controllers are typically configured to the type of system to which they are attached. For instance, the indoor unit of an HVAC system such as a furnace or air handler would have a different HVAC controller than the outdoor unit of the system. Outdoor units of a residential HVAC system can typically be classified as heat pumps or air conditioners. Accordingly, the controllers in the outdoor units are typically configured either for an air conditioning system or for a heat pump system. Controllers for air conditioners are installed in air conditioner systems and controllers for heat pumps are installed in heat pump systems. The controls for the two types of controllers differ in that air conditioning systems do not require all of the controls that are required for a heat pump system. For example, the controller for an air conditioner need not control a reversing valve or provide auxiliary heating.

In one type of known control system, a single type of controller may be installed on either an air conditioning system or a heat pump system. The problem with the single type of controller is that the controller needs to be configured to the particular system to which it is attached. A controller attached to an air conditioning system needs to be configured for the air conditioning system and does not need the various controls needed for the heat pump system. Likewise, a controller attached to a heat pump system needs to be configured for the heat pump system with the various controls required for a heat pump, such as control of the reversing valve and/or auxiliary heating.

In order to configure the controller to the system to which it is attached, a manual input is typically required from the installer or user of the system. To configure the controller, the controller is placed in a mode in which the type of system may be inputted. The input typically takes place either through the application of a jumper to the controller circuitry or through a user interface on the controller. The drawback of this system is that the manual configuration of the controller does not sense wiring errors and is subject to human error. In addition, manual configuration requires a greater amount of time, and therefore greater cost, during production assembly or during installation at a field service call.

What is needed is a system that automatically senses the type of system attached to the controller and configures the controller to control the attached system, which does not have the drawbacks of the prior art.

SUMMARY OF THE INVENTION

The present invention includes a method for configuring a controller for an HVAC system. The method comprises providing a closed loop refrigerant system and a control system to control the closed loop refrigerant system. The control system comprises a controller, an input device, such as a thermostat, and a processor including a signal sensing circuit. The input device is activated to provide one or more signals to the controller to control the components of the closed loop refrigerant system. The one or more signals are sensed with the signal sensing circuit to determine whether signals are present between the input device and the controller. The signals are processed with the processor to determine what type of closed loop refrigerant system is present. The controller is then configured to control the type of system determined by the processor.

The present invention also includes a method for configuring a controller for an HVAC system. The method comprises providing a closed loop refrigerant system and a control system to control the closed loop refrigerant system. The control system comprises a controller, and a processor including a signal sensing circuit. Signals are sensed with the signal sensing circuit to determine whether one or more signals are present between an input device, such as one or more sensors for a heat pump system, and the controller. The signals are processed with the processor to determine what type of closed loop refrigerant system is present. The controller is then configured to control the type of system determined by the processor.

The present invention also includes an HVAC system. The system comprises a closed loop refrigerant system having a condenser, an evaporator, a compressor and, optionally, a reversing valve. The HVAC system also includes a control system to control the closed loop refrigerant system. The control system comprises a controller, a processor and a signal sensing circuit. The signal sensing circuit is able to sense whether a signal is present between an input device, such as a thermostat or sensor, and the controller. The processor is capable of processing the signals with the processor to determine what type of closed loop refrigerant system is present. The controller is configurable to control the closed loop refrigerant system determined by the processor.

An advantage of the present invention is that the system and method of the present invention can determine whether the operational mode for an HVAC controller should be an air conditioner system or a heat pump system.

Another advantage of the present invention is that the system and method have the ability to determine if a wiring fault is present. For example, incorrect wiring, system malfunctions and/or bad connections may be detected through the use of the method and system of the present invention.

Another advantage of the present invention is that the automatic determination of the type of closed loop refrigerant system that is present allows a system to only energize required components for that particular system. For example, the system can detect whether the system is an air conditioner system or a heat pump system and will not activate the circuitry for control of a reversing valve if the system is an air conditioner system. The configuration of the controller to the particular system, either air conditioner or heat pump, therefore permits the system to save cycles and wear on the reversing valve output relays of the control in air conditioning mode. In addition, the energy for energizing the relay coil for the reversing valve will be conserved in air conditioning mode.

Another advantage of the present invention is that the determination of the operational mode of the system that is attached permits the controller to optimize controls based on the appropriate system. The operational modes for an air conditioner may be optimized independently from the operational modes of a heat pump.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
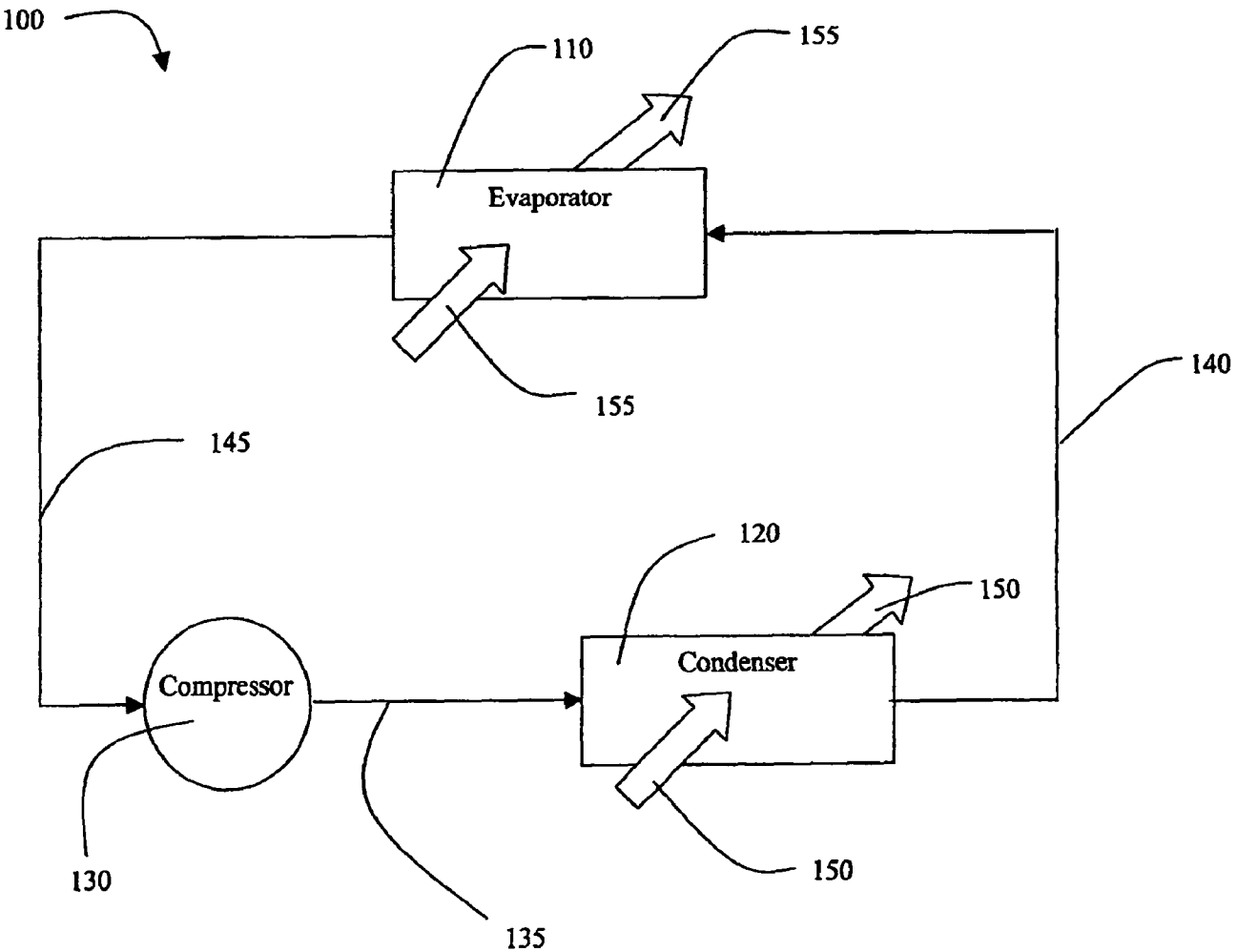
FIG. 1 schematically illustrates a refrigeration or air conditioning system.

FIG. 1 illustrates an air conditioner system 100. Air conditioner system 100 is a closed loop refrigerant system that includes a compressor 130, a condenser 120, and an evaporator 110. Refrigerant is circulated through the air conditioner system 100. The compressor 130 compresses a refrigerant vapor and delivers it to the condenser 120 through compressor discharge line 135. Any suitable type of compressor 130 may be used. For example, compressor 130 may be a screw compressor, scroll compressor, reciprocating compressor, rotary compressor, or centrifugal compressor. The refrigerant vapor delivered by the compressor 130 to the condenser 120 enters into a heat exchange relationship with a first heat transfer fluid 150 heating the fluid while undergoing a phase change to a refrigerant liquid as a result of the heat exchange relationship with the fluid 150. Suitable fluids for use as the first heat transfer fluid 150 include, but are not limited to, air. In a preferred embodiment, the refrigerant vapor delivered to the condenser 120 enters into a heat exchange relationship with air as the first heat transfer fluid 150. The refrigerant leaves the condenser 120 through the evaporator inlet line 140 and is delivered to an evaporator 110. The evaporator 110 includes a heat-exchanger coil. The liquid refrigerant in the evaporator 110 enters into a heat exchange relationship with a second heat transfer fluid 155 and undergoes a phase change to a refrigerant vapor as a result of the heat exchange relationship with the second fluid 155, which removes heat from the second heat transfer fluid 155. Suitable fluids for use as the second heat transfer fluid 155 include, but are not limited to, air and water. In a preferred embodiment, the refrigerant vapor delivered to the evaporator 10 enters into a heat exchange relationship with air as the second heat transfer fluid 155. The vapor refrigerant in the evaporator 110 exits the evaporator 110 and returns to the compressor 130 through a compressor suction line 145 to complete the cycle. The first heat transfer fluid 150 is moved by use of a fan (not shown), which moves the first heat transfer fluid 150 through condenser 120 in a direction perpendicular the cross section of the condenser 120. The second heat transfer fluid 155 is moved by use of a blower (not shown), which moves the second heat transfer fluid 155 through evaporator 110 in a direction perpendicular the cross section of the evaporator 110. Although a fan and blower are described as the fluid moving means, any fluid moving means may be used to move fluid through the evaporator 110 and condenser 120.

It is to be understood that any suitable configuration of evaporator 110 or condenser 120 can be used in the system 100, provided that the appropriate phase change of the refrigerant is obtained. Control of the various components of the air conditioner 100 system, including operation of the compressor 130, is achieved through the use of a controller. An air conditioner system 100 includes many other features that are not shown in FIG. 1. These features have been purposely omitted to simplify the figure for ease of illustration.

Figure 2:
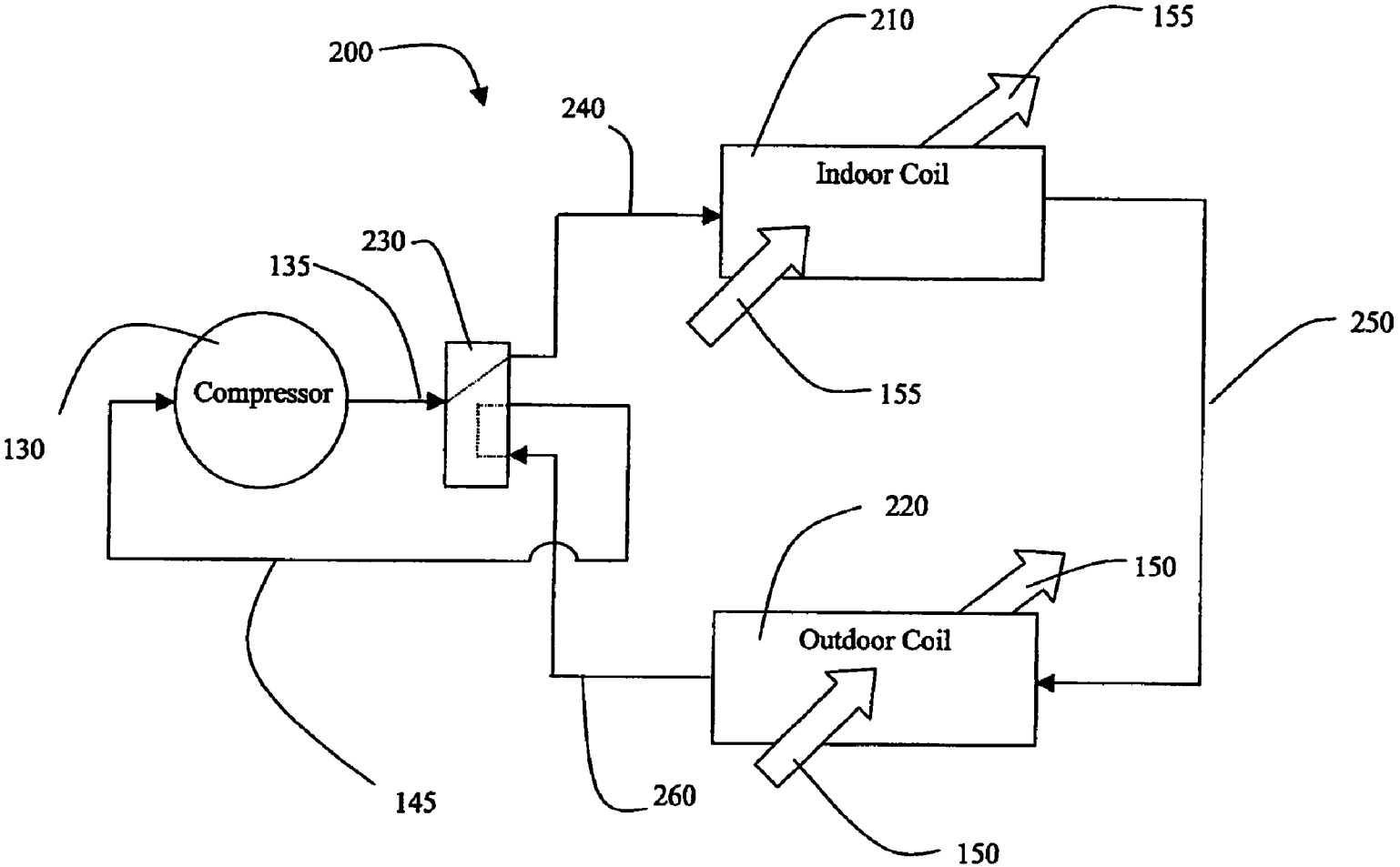
FIG. 2 schematically illustrates a heat pump system in heating mode.

FIG. 2 illustrates a heat pump system 200. Heat pump system 200 is a closed loop refrigerant system that includes a compressor 130, an indoor coil 210, an outdoor coil 220 and a reversing valve 230. The indoor coil 210 and the outdoor coil 220 function as either an evaporator or condenser based on the direction of refrigerant flow through the system. The reversing valve 230 is a valve that can direct flow of refrigerant to one of the indoor coil 210 and the outdoor coil 220, while simultaneously returning refrigerant to the compressor 130 from the other of the indoor coil 210 or the outdoor coil 220 of which the refrigerant first flowed. FIG. 2 illustrates refrigerant flow to provide heating to the indoor space. The compressor 130 compresses a refrigerant vapor and delivers it to the reversing valve 230 through compressor discharge line 135. The position of the reversing valve 230 is controlled by the controller. FIG. 2 illustrates refrigerant flow to provide heating to the indoor space. The reversing valve 230 is configured to direct refrigerant through line 240 to the indoor coil 210. The refrigerant vapor delivered from the reversing valve 230 to the indoor coil 210 enters into a heat exchange relationship with a second heat transfer fluid 155 heating the fluid while undergoing a phase change to a refrigerant liquid as a result of the heat exchange relationship with the fluid 155. In this embodiment, the indoor coil functions as a condenser. In a preferred embodiment, the refrigerant vapor delivered to the indoor coil 210 enters into a heat exchange relationship with air as the second heat transfer fluid 155 and heats the indoor space. The refrigerant leaves the indoor coil 210 through line 250 and is delivered to an outdoor coil 220. The outdoor coil 220 includes a heat-exchanger coil. The liquid refrigerant in the outdoor coil 220 enters into a heat exchange relationship with a first heat transfer fluid 150 and undergoes a phase change to a refrigerant vapor as a result of the heat exchange relationship with the first fluid 150, which removes heat from the first heat transfer fluid 150. In this embodiment, the outdoor coil functions as an evaporator. In a preferred embodiment, the refrigerant vapor delivered to the outdoor coil 220 enters into a heat exchange relationship with air as the first heat transfer fluid 150. The vapor refrigerant in the outdoor coil 220 exits the outdoor coil 220 and returns to the compressor 130 through compressor suction line 145 to complete the cycle.

Control of the various components of the heat pump system 200, including operation of the compressor and the reversing valve 230, is achieved through the use of a controller. FIG. 2 shows the positioning of the reversing valve 230 to flow refrigerant to the indoor coil 210 first, before traveling to the outdoor coil 220. The reversing valve 230 has an activated position, wherein the controller has the reversing valve 230 activated. The reversing valve 230 also has a default position, wherein activation is not required for the positioning of the valve. The reversing valve returns to the default position when no activation is present. The position in the embodiment shown in FIG. 2 can be one default position suitable for the reversing valve 230. The default position of the reversing valve 230 is not limited to that shown in FIG. 2, but may include any valve position that does not require additional energy to be placed into position. Heat pump system 200 includes many other features that are not shown in FIG. 2. These features have been purposely omitted to simplify the figure for ease of illustration.

Figure 3:
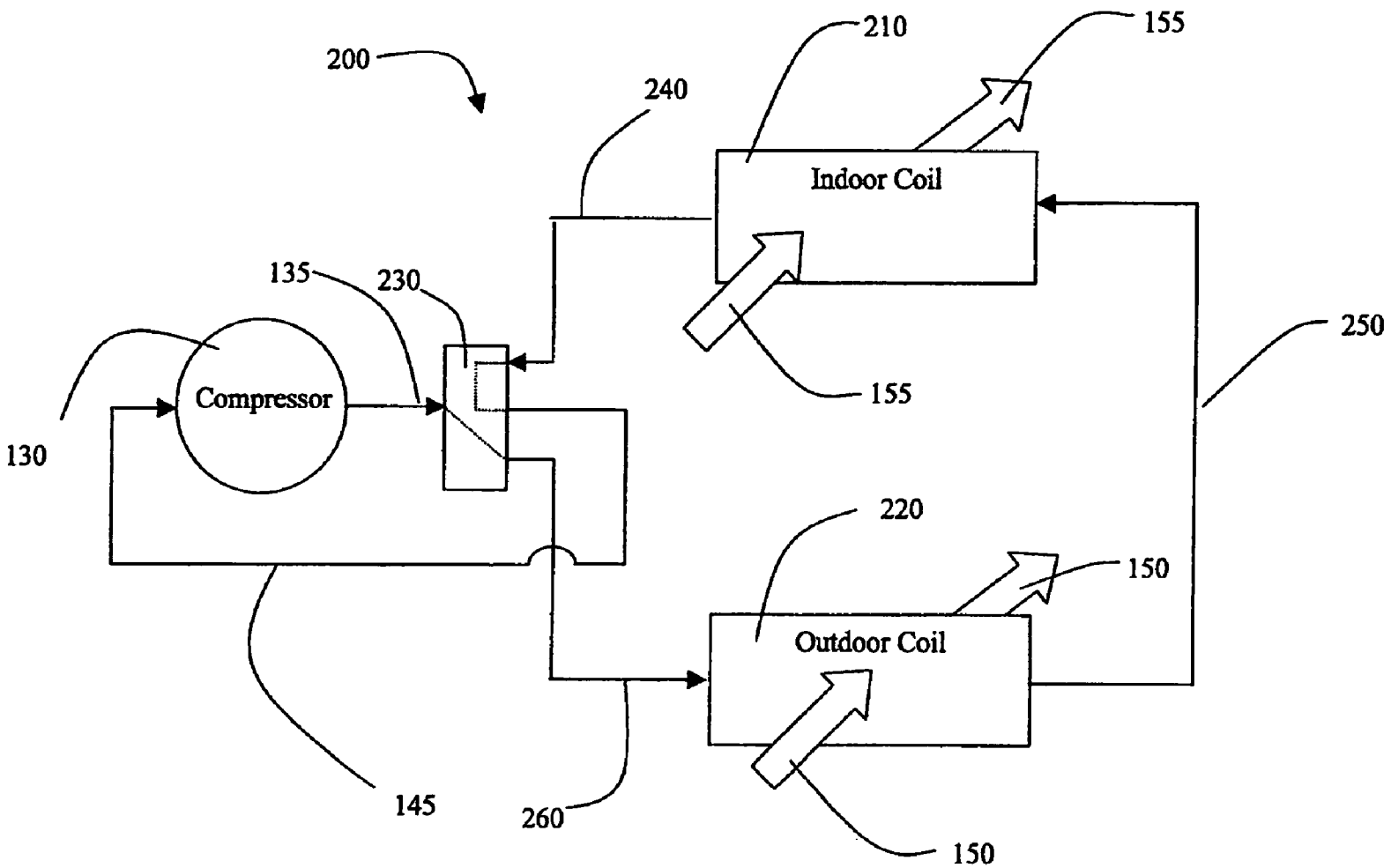
FIG. 3 schematically illustrates a heat pump system in cooling mode.

FIG. 3 illustrates a heat pump system 200 configured to provide cooling to the indoor space instead of heating as shown in FIG. 2. In this configuration, the reversing valve 230 is configured to direct refrigerant through line 260 to the outdoor coil 220. In this embodiment, the outdoor coil functions as a condenser. The refrigerant vapor delivered from the reversing valve 230 to the outdoor coil 220 enters into a heat exchange relationship with a first heat transfer fluid 150 heating the fluid while undergoing a phase change to a refrigerant liquid as a result of the heat exchange relationship with the fluid 150. The refrigerant leaves the outdoor coil 220 through line 250 and is delivered to an indoor coil 210. In this embodiment, the indoor coil functions as an evaporator. The liquid refrigerant in the indoor coil 210 enters into a heat exchange relationship with a second heat transfer fluid 155 and undergoes a phase change to a refrigerant vapor as a result of the heat exchange relationship with the second fluid 155, which removes heat from the second heat transfer fluid 155. To cool the indoor space, the vapor refrigerant is directed from the reversing valve 230 to the indoor coil 210, exits the indoor coil 210 and returns to the compressor 130 through compressor suction line 145 to complete the cycle.

Figure 4:
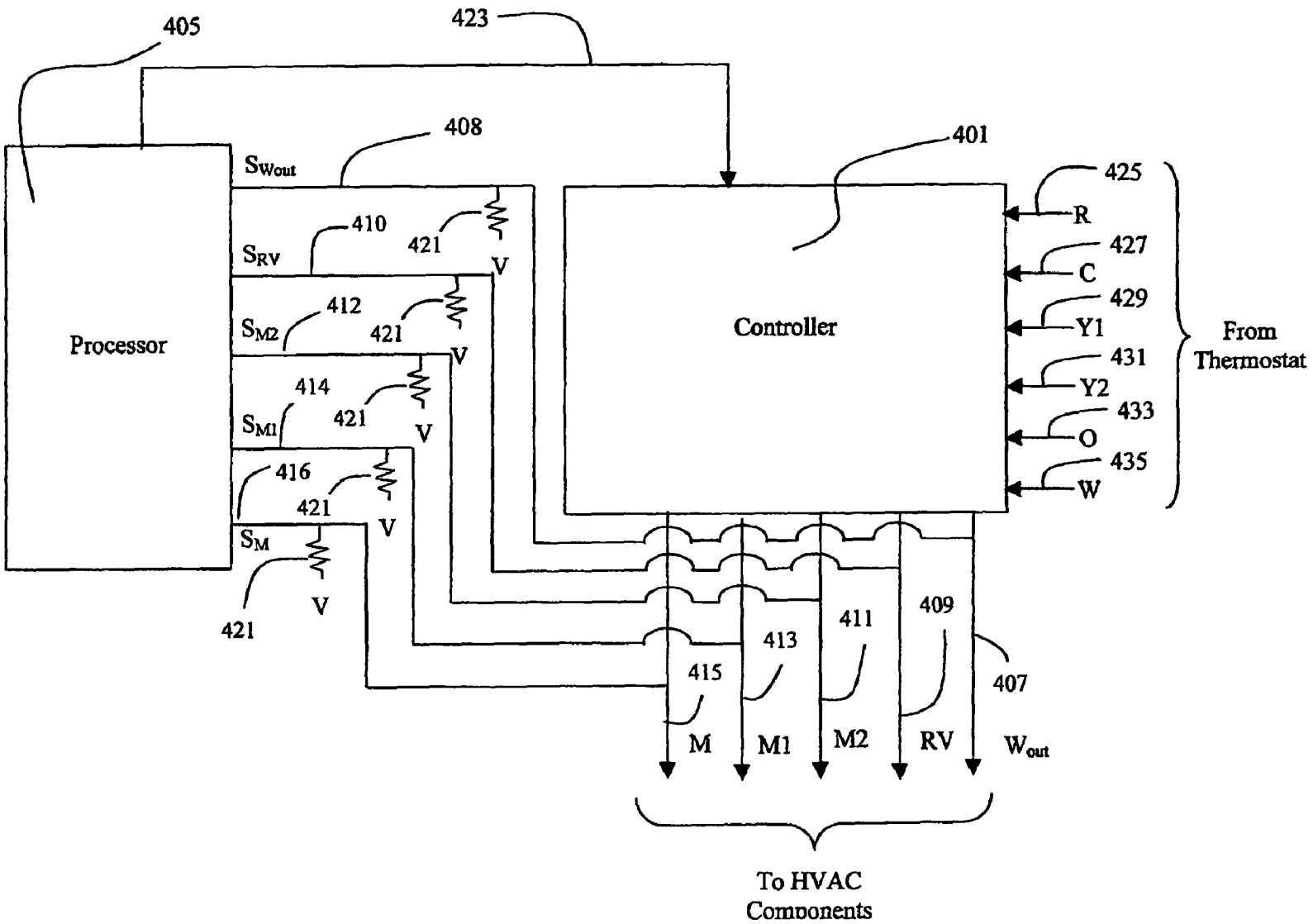
FIG. 4 schematically illustrates a control system of the present invention.

FIG. 4 schematically illustrates a control system according to one embodiment of the present invention. In FIG. 4, the control system is shown as including a controller 401, and a processor 405. The controller 401 is a device that receives input signals from input sources, such as thermostats and/or sensors and provides a control signal to the HVAC components to control the components of the closed loop refrigerant system. The HVAC components may include compressors 130, reversing valves 230, auxiliary heating coils (not shown) or any other components present in the system that operate within the closed loop refrigerant system. The control signals may be any signal that provides the control to the components of the closed loop refrigerant system. The control signals from the controller 401 include electrical signals that provide power and/or control to the various HVAC components. For example, controller 401 may provide a signal that activates the compressor 130 when the input source (e.g., a thermostat) provides a signal to the controller to instruct the controller that refrigerant compression (i.e., activation of the compressor or compressors) is required. Additionally, controller 401 may provide a control signal to activate the reversing valve 230 in a heat pump system 200 to reverse the direction of refrigerant flow through the indoor and outdoor coils 210 and 220. This change in direction results in a switch from heating to cooling or vice versa. The thermostat is a device that senses conditions, such as the temperature present in an interior space, and transmits particular control signals based on the measured values. FIG. 4 shows inputs to the controller 401 from a thermostat including inputs "R", "C", "Y1", "Y2", "O" and "W". The controller 401 uses the signals from the thermostat and outputs control signals, including "M", "M1", "M2", "RV", and "$W_{out}$". Although these signals, shown in FIGS. 4-9, are shown from a thermostat, any device capable of providing signals to the controller for operation of the HVAC system may be used. Further, although this embodiment has been described with respect to the controller outputs "M", "M1", "M2", "RV" and "$W_{out}$", the invention is not limited to these particular outputs. Any control signals that may be configurable to control either an air conditioner system 100 or a heat pump system 200 may be used. In this embodiment, "M" output line 415, "M1" output line 413 and "M2" output line 411 may be control lines for operation of one or more compressors 130, useful with both the heat pump system 200 and the air conditioner system 100. The "RV" output line 409 may be an output from controller 401 that calls for activation of the reversing valve, useful with the operation of a heat pump system 200. The "$W_{out}$" output line 413 may be an output line from controller 401 that calls for auxiliary heat, useful with the operation of a heat pump system 200.

Load sensor lines 408, 410, 412, 414 and 416 are attached to each of the output lines and are connected to the processor 405. Although FIG. 4 shows the processor 405 and controller 401 as different units, the processor 405 may be integrated into the controller or may be separate from the controller 401. Load sensor lines are lines that sense the presence of an electrical load on the output line connected to the sensor. The presence of a load would correspond to circuitry related to an HVAC component, such as a compressor. The absence of a load would correspond to a terminal that is not connected to an HVAC component. Specifically, in this embodiment, load sensor line 416 is connected to output line 415 and provides input "$S_M$" to the processor. Load sensor line 414 is connected to output line 413 and provides input "$S_{M1}$" to the processor. Load sensor line 412 is connected to output line 411 and provides input "$S_{M2}$" to the processor. Load sensor line 410 is connected to output line 409 and provides input "$S_{RV}$" to the processor. Load sensor line 408 is connected to output line 407 and provides input "$S_{Wout}$" to the processor. Each of load sensor lines 408, 410, 412, 414 and 416 has a load sensing circuit including resistors 421 connected to a voltage "V". The voltage "V" is any voltage that may be used by the processor to determine if a load is present on the output lines 407, 409, 411, 413 and 415.

Processor 405 senses the presence or absence of loads on output lines 407, 409, 411, 413 and 415 via load sensor lines 408, 410, 412, 414 and 416. Processor 405 is a device that processes signals and produces an output based on the signals sensed from the load sensor lines 408, 410, 412, 414 and 416 to the controller 401. If the load sensor line reads a voltage equal to voltage "V", processor 405 determines that there is no load on that corresponding output line 407, 409, 411, 413 or 415. If the processor 405 senses a voltage of zero volts (i.e., the ground voltage level), the corresponding output line 407, 409, 411, 413 or 415 has a load on it. For example, if the processor 405 determines from load sensor line 410 that "$S_{RV}$", corresponding to the signal from the controller 405 for the reversing valve 230, has a load present on it, it may be determined that the system being controlled is a heat pump system 200. The processor 405 uses the inputs from the load sensor lines 408, 410, 412, 414 and 416 to determine whether the system is an air conditioner or a heat pump. Once the processor 405 determines whether the system is a heat pump system 200, an air conditioner system 100 or a wiring fault, the processor 405 transmits an output on line 423 to the controller, which configures itself appropriately as a heat pump system 200, or an air conditioning system 100. Although FIG. 4 shows that the processor 405 and controller are separate components, the components may be integrated into a single component, wherein the processor utilizes the signals from the load sensing circuits to determine the type of system present and also processes input signals from the thermostat to provide the control signals via lines 407, 409, 411, 413 and/or 415. In one embodiment of the invention, the controller 401 is placed in a configuration mode either automatically or by a user, such as an installer or a manufacturer. While in the configuration mode, the processor determines the combination of loads present on load sensor lines 408, 410, 412, 414 and 416 providing inputs to the processor 405 indicating loads on inputs "$S_{Wout}$", "$S_{RV}$", "$S_{M2}$", "$S_{M1}$" and "$S_M$". The processor determines the type of system present based upon the combination of loads or absence of loads present and transmits the information to the controller, which is configured to the type of system present. As shown in FIG. 4, all of the output lines are present and corresponds to the line connections required for a heat pump system 200. Therefore, in the system in FIG. 4, the processor 405 may conclude that the system to which the controller is attached is a heat pump system 200 and not an air conditioner system 100. The controller 401 may configure itself accordingly as a heat pump system 200. Configuration of the controller 401 may take place in any suitable manner, including, but not limited to, programming of a microprocessor in the controller 401 to provide control signals appropriate for the system to which the controller is attached. Configuration of the controller 401 may take place in any suitable manner, including, but not limited to, programming of a microprocessor in the controller 401 to provide control signals appropriate for the system to which the controller is attached.

Figure 5:
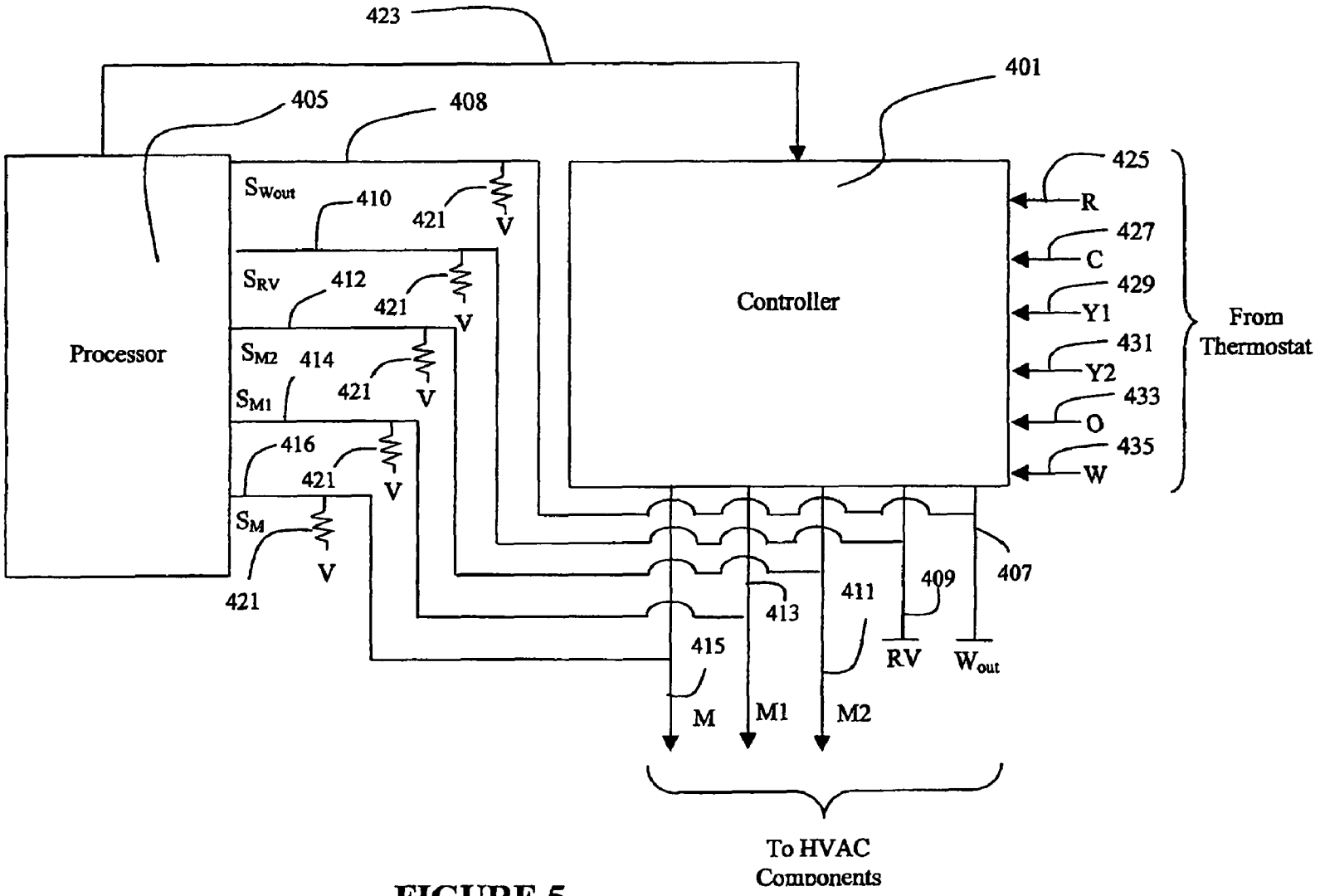
FIG. 5 schematically illustrates a control system of an alternate embodiment of the present invention.

FIG. 5 schematically illustrates an air conditioner system according to another embodiment of the present invention. FIG. 5 includes substantially the same arrangement of controller 401 and processor 405 as shown in FIG. 4. In addition, FIG. 5 has output lines 407, 409, 411, 413 and 415, including load sensor lines 408, 410, 412, 414 and 416 with inputs "$S_{Wout}$", "$S_{RV}$", "$S_{M2}$", "$S_{M1}$" and "$S_M$", respectively, and load sensing circuit including the pull-up resistors 421, as shown in FIG. 4. Unlike FIG. 4, the outputs lines 409 and 407 are not connected to HVAC components wherein no load is present on output lines 409 and 407. To configure the controller 401 in this embodiment of the invention, the controller 401 is placed in a configuration mode either automatically or by a user, such as an installer or a manufacturer. While in the configuration mode, the processor 405 determines the combination of loads present or absent on load sensor lines 408, 410, 412, 414 and 416 providing inputs to the processor 405 indicating which loads are present and which are absent on inputs "$S_{Wout}$", "$S_{RV}$", "$S_{M2}$", "$S_{M1}$" and "$S_M$". The processor 405 determines the type of system present based upon the combination of loads or absence of loads present and transmits the information to the controller 401, which is configured to the type of system present. The system in FIG. 5 does not include connections on output lines 407 and 409 and therefore do not have loads present thereon. Therefore, as shown in FIG. 5, loads would be sensed on one or more of output lines 411, 413 and 415. Accordingly, load sensor lines 412, 414 and 416 provide load signals to the processor 405 indicating loads on one or more of inputs "$S_{M2}$", "$S_{M1}$" and "$S_M$". In addition, load sensor lines 410 and 408 provide inputs to the processor indicating no load on inputs "$S_{RV}$"and "$S_{wout}$". Although the controller 401 is capable of attaching to HVAC components on output lines 407 and 409, the absence of an HVAC component provides a signal indicating no load present on output lines 407 and 409. Because no load is sensed on the controller 401 outputs corresponding to the reversing valve 230, and auxiliary heat output line 407, the processor 405 can then conclude that the system to which the controller 401 is attached is an air conditioning system 100 and not a heat pump system 200. The processor 405 then communicates to the controller 401 via line 423 that the system is an air conditioner system 100 and the controller 401 may configure itself accordingly as an air conditioner system 100. Configuration of the controller 401 may take place in any suitable manner, including, but not limited to, programming of a microprocessor in the controller 401 to provide control signals appropriate for the system to which the controller is attached.

Although FIGS. 4 and 5 show five signal lines going to the processor 405, including signal lines 408, 410, 412, 414 and 416, any number of signal lines may be used, as long as sufficient lines are used to determine whether the system is an air conditioner or a heat pump. One embodiment of the invention includes a signal line 410 on "RV", wherein a load on line 409 indicates that the controller 401 is providing a load such that there is an indication "$S_{RV}$" for the reversing valve 230. Since the reversing valve 230 is present in the heat pump system 200 and not the air conditioner system 100, the processor 405 may conclude that the system is a heat pump system 200 and configure the controller 401 accordingly. Likewise, the present invention is not limited to the designations for outputs "M", "M1", "M2", "RV" and "$W_{out}$". Any combination of control outputs may be used, so long as the control outputs from the controller 401 are unique to a heat pump system 200 or an air conditioner system 100. In addition, processor 405 may determine that there is a wiring fault present. A wiring fault is a problem with the system that results in an error in the control system. Typically, a wiring fault may occur due to incorrect wiring or bad connections. An example of a wiring fault would result if a load is sensed on input "$S_{RV}$" and no load is sensed any of input lines "$S_M$", "$S_{M1}$" or "$S_{M2}$". The load signal combination indicates that the controller 401 is connected to the reversing valve 230; however, there is no compressor present. Therefore, the processor 405 may produce a wiring fault result. The wiring fault may be transmitted to the controller 401 and the controller 401 may be configured in a default mode and/or may indicate to the system user that there is a wiring fault.

Although FIGS. 4-5 are shown with pull-up resistor resistive arrangements as load sensing circuits, the sensors could be sensed by another means other than using a pull-up resistor. Different circuitry such as an analog-to-digital converter could be used.

Figure 6:
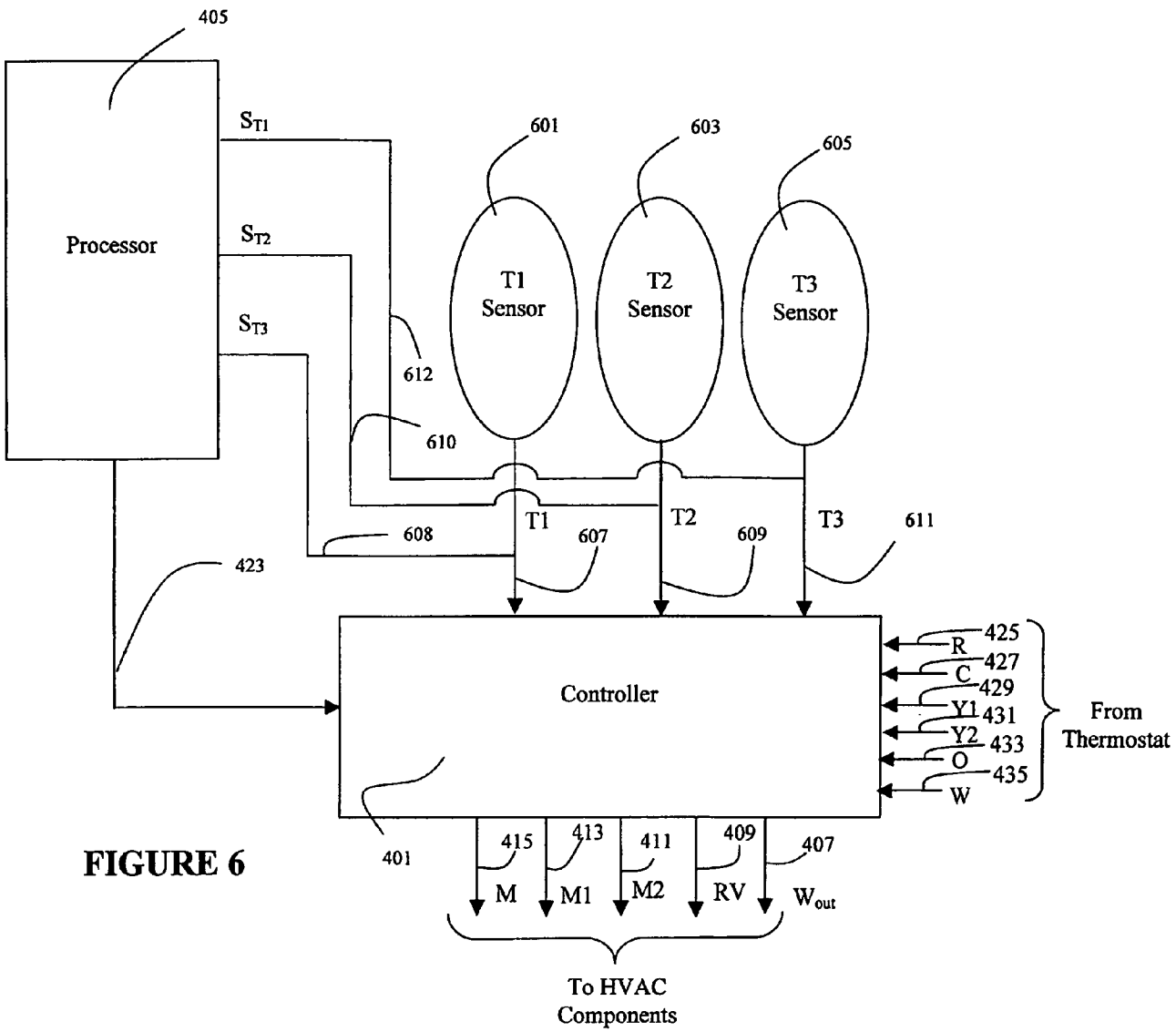
FIG. 6 schematically illustrates a control system of still another embodiment of the present invention.

FIG. 6 schematically illustrates an HVAC system according to another embodiment of the present invention. The closed loop refrigerant system includes a controller 401, a processor 405, a T1 Sensor 601, a T2 Sensor 603, and a T3 Sensor 605. Controller 401 includes input control signals "R", "C", "Y1", "Y2", "O" and "W" from a thermostat, as shown and described above with respect to FIGS. 4-5. The controller 401 also includes outputs "M", "M1" and "M2", "RV", "$W_{out}$", as shown and described with respect to FIGS.

4-5. In addition, sensor outputs "T1", "T2" and "T3" represent sensor outputs on sensor output lines 607, 609 and 611, respectively, typically found in a heat pump system 200. For example, sensor outputs "T1", "T2" and "T3" may include a signal corresponding to a liquid line coil temperature measurement, an outdoor temperature measurement and/or a compressor discharge line temperature measurement. The signal may be any electrical signal that can be sensed by the processor, including but not limited to, voltages, or currents generated by the T1 Sensor 601, T2 Sensor 603, or T3 Sensor 605. FIG. 6 has sensor output lines 607, 609 and 611, corresponding to sensor outputs "T1", "T2" and "T3". Attached to each of sensor output lines 607, 609 and 611 are sensor lines 608, 610 and 612. The sensor arrangement in FIG. 6 provides signals produced by the sensors 601, 603 and 605 to processor 405. Specifically, sensor lines 608, 610 and 612 deliver inputs "$S_{T1}$", "$S_{T2}$" and "$S_{T3}$", respectively, to the processor 405. Because each of sensor outputs "T1", "T2" and "T3" are unique to a heat pump system 200, a signal sensed on one or more of load sensor inputs "$S_{T1}$", "$S_{T2}$" and "$S_{T3}$" permits the processor 405 to conclude that the system is a heat pump system 200. However, if the processor 405 senses no signal on all of load sensor inputs "$S_{T1}$", "$S_{T2}$" and "$S_{T3}$", the processor 405 is permitted to determine that the system is an air conditioner system 100, because no sensor for a heat pump system is present. Although FIG. 6 shows three sensors T1, T2 and T3 601, 603 and 605, and three sensor output lines 608, 610 and 612, the system of the present invention may utilize any number of sensors and sensor outputs, as long as the sensors provide signals to controller 401 and to processor 405 that permit determination of whether the system is a heat pump system 200 or an air conditioner system 100. To configure the controller 401 in this embodiment of the invention, the controller 401 is placed in a configuration mode either automatically or by a user, such as an installer or a manufacturer. While in the configuration mode, the processor 405 determines the combination of signals present or absent on lines 607, 609 and 611 and uses the presence or absence of signals to determine whether the system is a heat pump system or an air conditioner system. Once the processor 405 makes a determination, the controller 401 configures itself to the determined type of system. While FIG. 6 has been described with the respect to sensor lines 608, 610 and 612 sensing voltages and/or currents from sensors on lines 607, 609 and 611, sensor lines 608, 610 and 612 may also be configured with load sensing arrangements, such as the arrangement shown in FIGS. 4 and 5, wherein a signal indicating a load or absence of a load is provided to the processor 405 to determine whether a sensor is connected to the controller 401. In this embodiment, if no sensor is connected to the controller (i.e., no load is sensed), the processor 405 may determine that the system is an air conditioner and the controller 401 may configure itself appropriately. Configuration of the controller 401 may take place in any suitable manner, including, but not limited to, programming of a microprocessor in the controller 401 to provide control signals appropriate for the system to which the controller is attached.

Figure 7:
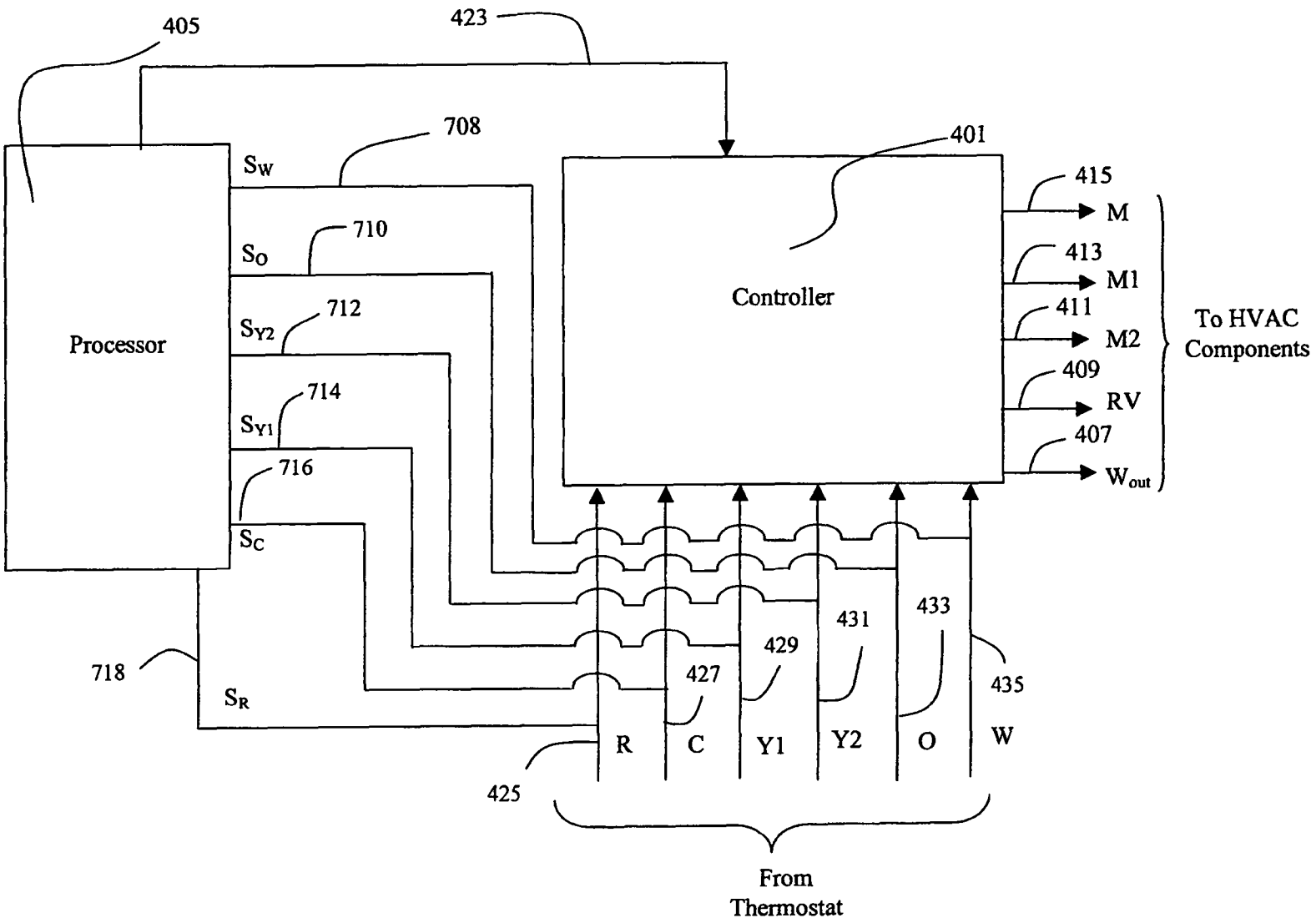
FIG. 7 schematically illustrates a control system of still another embodiment of the present invention.

FIG. 7 schematically illustrates an alternate arrangement of a control system according to another embodiment of the present invention. The arrangement of the controller 401, processor 405, thermostat signals from the thermostat, and the output signals to the HVAC components are substantially identical to the systems illustrated in FIGS. 4-6. For example, like in FIGS. 4-6, controller 401 may provide a signal that activates the compressor 130 when the input source (e.g., a thermostat) provides a signal to the controller to instruct the controller that refrigerant compression (i.e., activation of the compressor or compressors) is required. Additionally, controller 401 may provide a control signal to activate the reversing valve 230 in a heat pump system 200 to reverse the direction of refrigerant flow through the indoor and outdoor coils 210 and 220. FIG. 7 shows inputs to the controller 401 from a thermostat including inputs "R", "C", "Y1", "Y2", "O" and "W". The controller 401 uses the signals from the thermostat and outputs control signals, including "M", "M1", "M2", "RV", and "$W_{out}$". Although these signals, shown in FIGS. 4-9, are shown from a thermostat, any device capable of providing signals to the controller for operation of the HVAC system may be used. However, unlike FIGS. 4-6, the processor 405 includes alternative circuitry from the circuitry shown in FIGS. 4-6 to sense signals on the inputs to the controller 401 from the thermostat or other input device. The signal may be any electrical signal that can be sensed by the processor 405, including but not limited to, voltages, or currents generated by the thermostat. The thermostat is a device that senses conditions, such as the temperature present in an interior space, and transmits particular control signals based on the measured values. FIG. 7 shows inputs to the controller 401 from a thermostat including inputs "R", "C", "Y1", "Y2", "O" and "W" utilizing lines 425, 427, 429, 431, 433 and 435, respectively. In this embodiment, the "R" input line 425 may be a signal line for power to the system, useful with both the heat pump system 200 and the air conditioner system 100. The "C" input line 427 may be a power ground wire, useful with both the heat pump system 200 and the air conditioner system 100. The "Y1" and "Y2" input lines 429 and 431 may include lines that call for the activation of one or more compressors, useful with both the heat pump system 200 and the air conditioner system 100. The "O" input line 433 may be an input from controller 401 that calls for activation of the reversing valve, useful with the operation of a heat pump system 200. The "W" input line 435 may be an input line from thermostat that calls for auxiliary heat, useful with the operation of a heat pump system 200.

Sensor lines 708, 710, 712, 714, 716 and 718 are attached to each of the input lines and are connected to the processor 405. Although FIG. 7 shows the processor 405 and controller 401 as different units, the processor 405 may be integrated into a single component. Sensor lines 425, 427, 429, 431, 433 and 435 sense the presence or absence of an electrical signal coming from the controller 401 to the HVAC components. Specifically, in this embodiment, sensor line 718 is connected to input line 425 and provides input "$S_R$" to the processor. Sensor line 716 is connected to input line 427 and provides input "$S_C$" to the processor. Sensor line 714 is connected to input line 429 and provides input "$S_{Y1}$" to the processor. Sensor line 712 is connected to input line 431 and provides input "$S_{Y2}$" to the processor. Sensor line 710 is connected to input line 433 and provides input "$S_O$" to the processor. Sensor line 708 is connected to input line 435 and provides input "$S_W$" to the processor 405.

Processor 405 senses the inputs (i.e., presence or absence of a signal) from sensor lines 708, 710, 712, 714, 716 and/or 718 and determines whether signals are present on input lines 425, 427, 429, 431, 433, and/or 435. Processor 405 processes the signals sensed on input lines 425, 427, 429, 431, 433, and/or 435 and produces an output based on the combination of signals present. For example, if the processor 405 determines from sensor line 710 that "$S_O$", corresponding to the signal from the thermostat for the reversing valve 230, has a signal present on it, it may be determined that the system being controlled is a heat pump system 200. The processor 405 uses the inputs from the sensor lines 708, 710, 712, 714, 716 and/or 718 to determine whether the system is an air conditioner 100 or a heat pump 200. Once the processor 405 determines whether the system is a heat pump system 200, an air conditioner system 100 or a wiring fault, the processor transmits an output on line 423 to the controller, which configures itself appropriately as a heat pump system 200, or an air conditioning system 100. To configure the controller 401 in this embodiment of the invention, the controller 401 is placed in a configuration mode either automatically or by a user, such as an installer or a manufacturer. While in the configuration mode, the processor 405 determines the combination of signals present or absent on input lines 425, 427, 429, 431, 433, and/or 435 and uses the presence or absence of signals to determine whether the system is a heat pump system or an air conditioner system. Once the processor 405 makes a determination, the controller 401 configures itself to the determined type of system. Configuration of the controller 401 may take place in any suitable manner, including, but not limited to, programming of a microprocessor in the controller 401 to provide control signals appropriate for the system to which the controller is attached.

Figure 8:
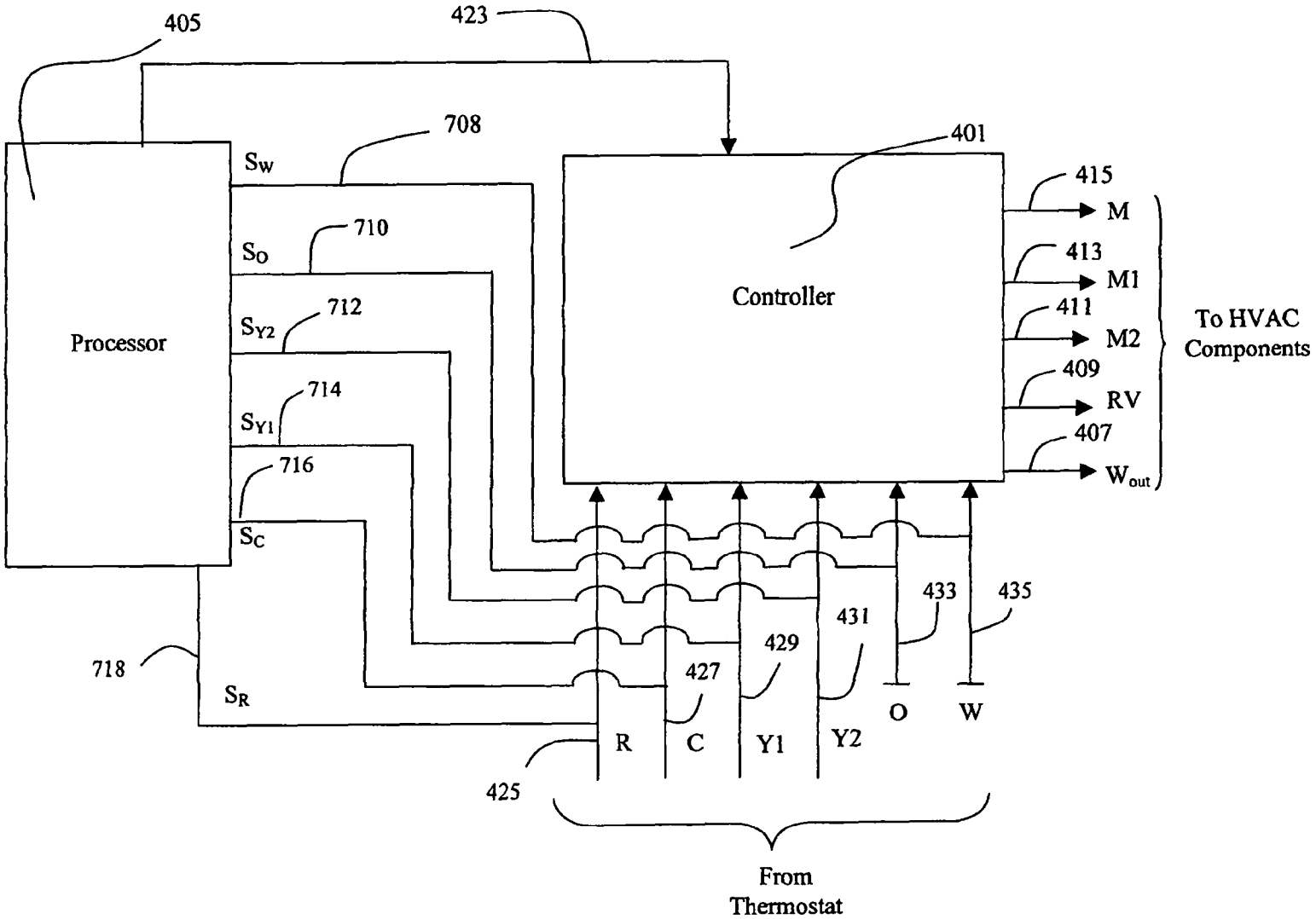
FIG. 8 schematically illustrates a control system of still another embodiment of the present invention.

FIG. 8 schematically illustrates an air conditioner system according to another embodiment of the present invention. FIG. 8 includes substantially the same arrangement of controller 401 and processor 405 as shown in FIG. 7. In addition, FIG. 8 has input lines 425, 427, 429, 431, 433, and 435, including sensor lines 708, 710, 712, 714, 716 and 718 attached thereto, with inputs "$S_R$", "$S_C$", "$S_{Y1}$", "$S_{Y2}$", "$S_O$" and "$S_W$", respectively, as shown in FIG. 7. Unlike FIG. 7, the input lines 433 and 435 are not connected to the thermostat or other input device and do not permit signals to be present on input lines 433 and 435. To configure the controller 401 in this embodiment of the invention, the controller 401 is placed in a configuration mode either automatically or by a user, such as an installer or a manufacturer. While in the configuration mode, the processor 405 determines the combination of signals present or absent on input lines 425, 427, 429, 431, 433, and/or 435 and uses the presence or absence of signals to determine whether the system is a heat pump system or an air conditioner system. In the configuration shown in FIG. 8, no connection exists with respect to input lines 433 and 435 and therefore cannot carry a signal. Once the processor 405 makes a determination, the controller 401 configures itself to the determined type of system. Configuration of the controller 401 may take place in any suitable manner, including, but not limited to, programming of a microprocessor in the controller 401 to provide control signals appropriate for the system to which the controller is attached.

Figure 9:
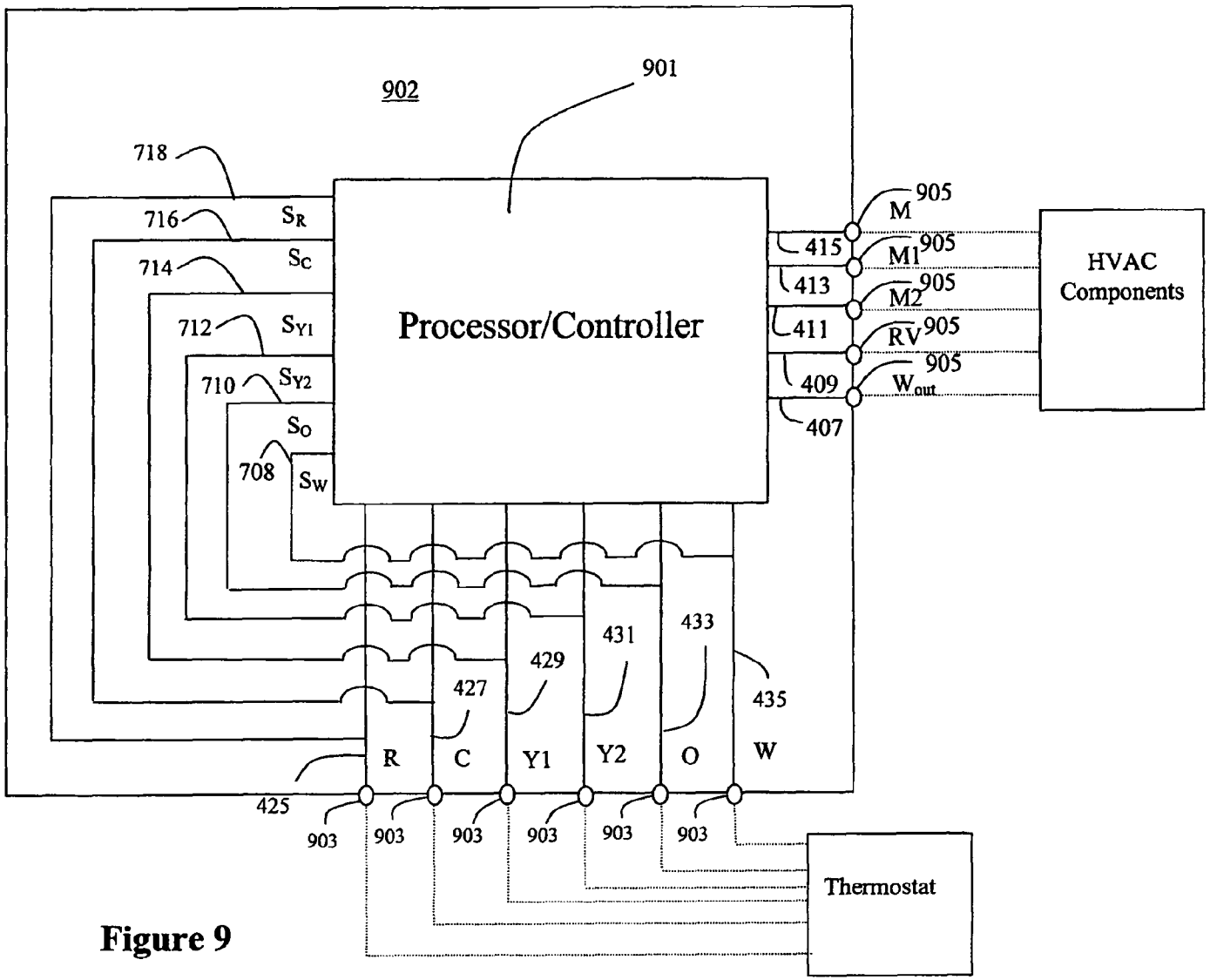
FIG. 9 schematically illustrates an integrated control system of an embodiment of the present invention.

FIG. 9 shows an alternate embodiment of the present invention with a processor/controller 901 mounted on a control board 902. The control board 902 includes input lines 425, 427, 429, 431, 433 and 435 from the processor/controller 901 to terminals 903. The control board 902 also includes output lines 407, 409, 411, 413 and 415 from the processor/controller 901 to terminals 905. The terminals 903 and 905 include connectors capable of attaching to wiring for a thermostat or other HVAC system related component, such as clips, screws or similar electrical connection. The processor/controller 901 is configured to provide the functions of both the processor 405 and the controller 401. Specifically, the processor/controller 901 is capable of sensing signals on input lines 425, 427, 429, 431, 433, and 435, configuring the processor/controller 901 based upon the sensed signals and processing the input signals from the thermostat or other input device to provide output signals on output lines 407, 409, 411, 413 and/or 415. Although FIG. 9 shows wiring attached to each of terminals 903 and 905, wires may be attached to one or more of the terminals 903 and 905. The utilization of a single control board 902 embodying a processor/controller 901 permits the installation of a uniform control board 902 for a variety of systems employing a variety of different types of compressors. In order to provide the proper control for the particular type of HVAC system attached to the system, the operator, such as a manufacturer or installer of the system, need only wire the system to the terminals 903, provide a signal from the thermostat corresponding to the type of system attached, sense the signals from the thermostat and configure the processor/controller 901 to the type of system attached.

Figure 10:
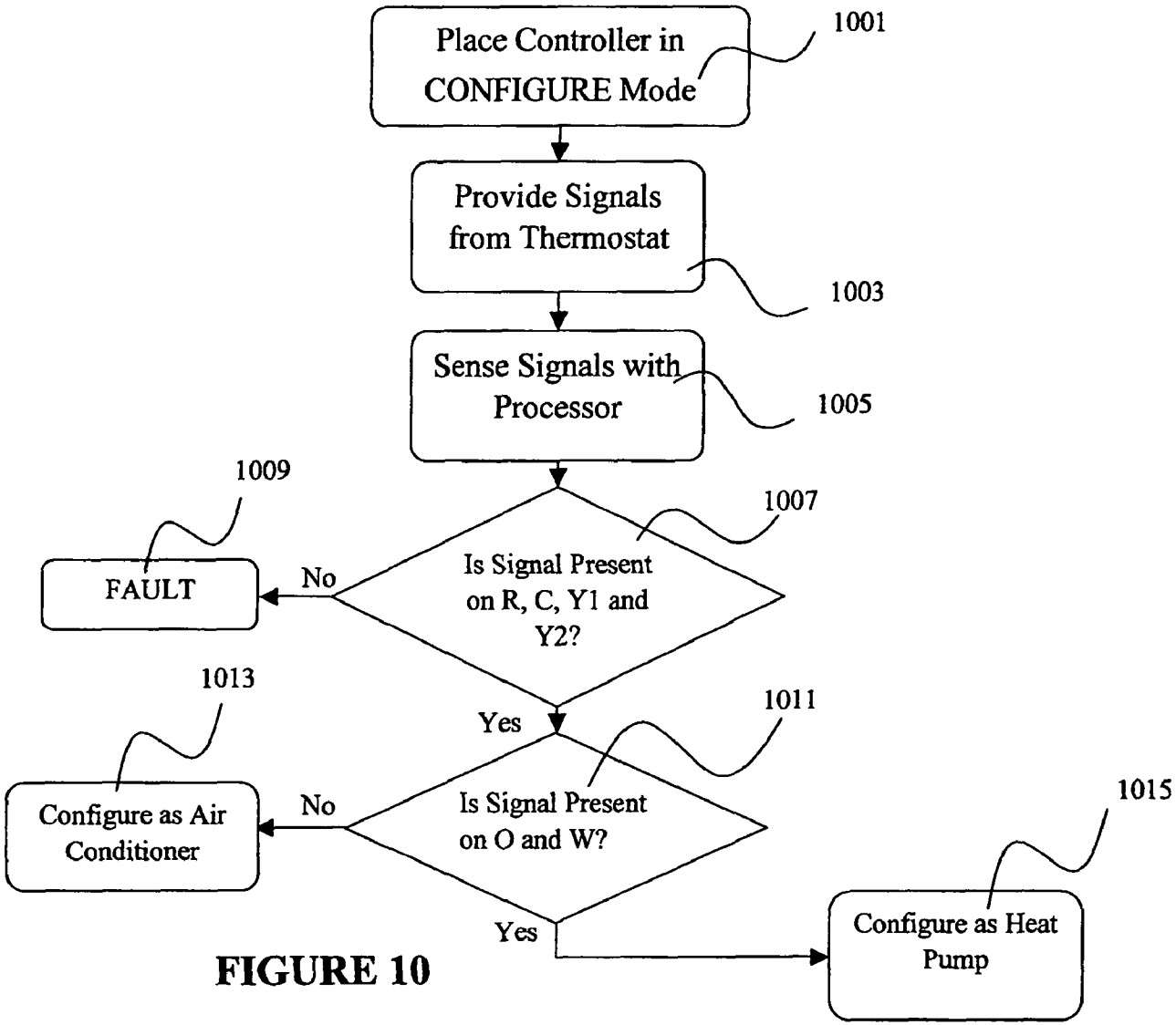
FIG. 10 illustrates a control method according to an alternate embodiment of the present invention.

FIG. 10 shows a method according to the present invention, corresponding to the systems shown in FIGS. 7 and 8. After the HVAC system is installed, the thermostat is placed in a configuration mode, shown as "CONFIGURE mode" in FIGS. 10 and 11, in step 1001. CONFIGURE mode is a mode in which the controller 401 may be configured to the appropriate type of system connected based on the combination of sensed signals from the thermostat or other input device. The CONFIGURE mode may be initiated by an operator of the system including, but not limited to, a manufacturer, an installer or a service technician. The CONFIGURE mode may also be activated automatically, such as at startup of the system or at predetermined intervals during operation. Signals are provided to the controller 401 in step 1003. Step 1003 may include any method of producing a predetermined set of thermostat outputs, including, but not limited to, initiating a computer algorithm or manually throwing the thermostat temperature settings to call for maximum heat. The predetermined set of inputs from the thermostat or other input device are the inputs that would result in the controller 401 providing outputs to operate various HVAC components corresponding to the type of system to which the controller 401 is attached. For example, a thermostat connected to a heat pump will provide a combination of signals (e.g., a signal on "O" and/or "W") to the controller 401 that will, in turn, have the controller 401 provide a load on the output line from the controller 401 for the reversing valve 230 (i.e., "$S_{RV}$") and/or auxiliary heating (i.e., "$S_{Wout}$"). The signals from the thermostat are monitored in step 1005. In determination step 1007, signal sensor inputs "$S_R$", "$S_C$", "$S_{Y1}$" and "$S_{Y2}$" are transmitted to the processor 405 through signal sensor lines 718, 716, 714 and 712 and it is determined whether there is a signal present on at least one of input lines 425, 427, 429 and/or 431. If step 1007 determines that no signal is present on any of lines 425, 427, 429 or 431, the method continues to step 1009 wherein the method may record a wiring fault and end the process. Because the compressor 130 would be activated in either the air conditioner system 100 or the heat pump system 200 in CONFIGURE mode, the processor 405 determines that there is an error and returns a wiring fault. A wiring fault may indicate that there is a problem with the system. For example, the thermostat or other input device may be providing incorrect inputs to the controller 401, the controller 401 may be providing incorrect outputs to the HVAC system components or the wiring may be incorrect. A wiring fault may be communicated to the system user and may indicate that the system may need service. If sensor inputs "$S_R$", "$S_C$", "$S_{Y1}$" and "$S_{Y2}$" indicate signals on lines 425, 427, 429 or 431, the method may proceed to step 1011.

As shown in FIG. 10, step 1011 determines whether a signal is present on line 433 or 435. Signal sensor inputs "$S_W$" and "$S_O$" are transmitted to the processor 405 through load sensor line 410 and it is determined whether there is a signal present on lines 433 and 435. If signal sensor input "$S_W$" shows no signal on line 435, and signal sensor input "$S_O$" shows no signal on line 433, the method may proceed to step 1013, which configures the controller 401 to an air conditioner system 100. If signal sensor input "$S_W$" shows a signal on line 435, and signal sensor input "$S_O$" shows a signal on line 433, the method may proceed to step 1013, which configures the controller 401 to a heat pump system 200.

FIG. 10 illustrates an embodiment wherein the wiring fault stops the process at step 1009. In an alternate embodiment, the process may continue monitoring the outputs through a process return to step 1003. In such a configuration, the controller 401 may be configured in a predetermined operational mode, such as a safe or default operation. Likewise, although step 1013 and 1015 end the process, the process may be continued by a return to step 1005 after operational configuration of the controller 401 is determined. In an alternate embodiment of the invention, the process may also stop after the configuration of the controller 401 is made or may continue for a predetermined amount of time.

Although FIG. 10 is shown as including sensor inputs from each of the controller inputs "R", "C", "Y1", "Y2", "O" and "W", the method may use any combination of one or more signals that are unique to the heat pump system 200. Additionally, combinations of inputs to the controller 401 used for both the air conditioner system 100 and the heat pump system 200, such as inputs "Y1", and "Y2" Sensing a signal on one or more sensor inputs used for both the air conditioner system 100 and the heat pump system 200 allows the processor 405 to check for wiring faults and/or errors in the configuration of the system by determining whether the input required for both systems includes a signal. If no signal is present on the sensor input or inputs used for both the air conditioner system 100 and the heat pump system 200, the system may determine that a wiring fault exists. In an alternate embodiment, the processor 405 senses inputs used for only the heat pump system 200, such as input "O" and/or "W" on lines 433 and 435, and determines the type of system used. If a signal is present on line 433 or 435 during the CONFIGURE mode, the system is configured as a heat pump system 200.

Figure 11:
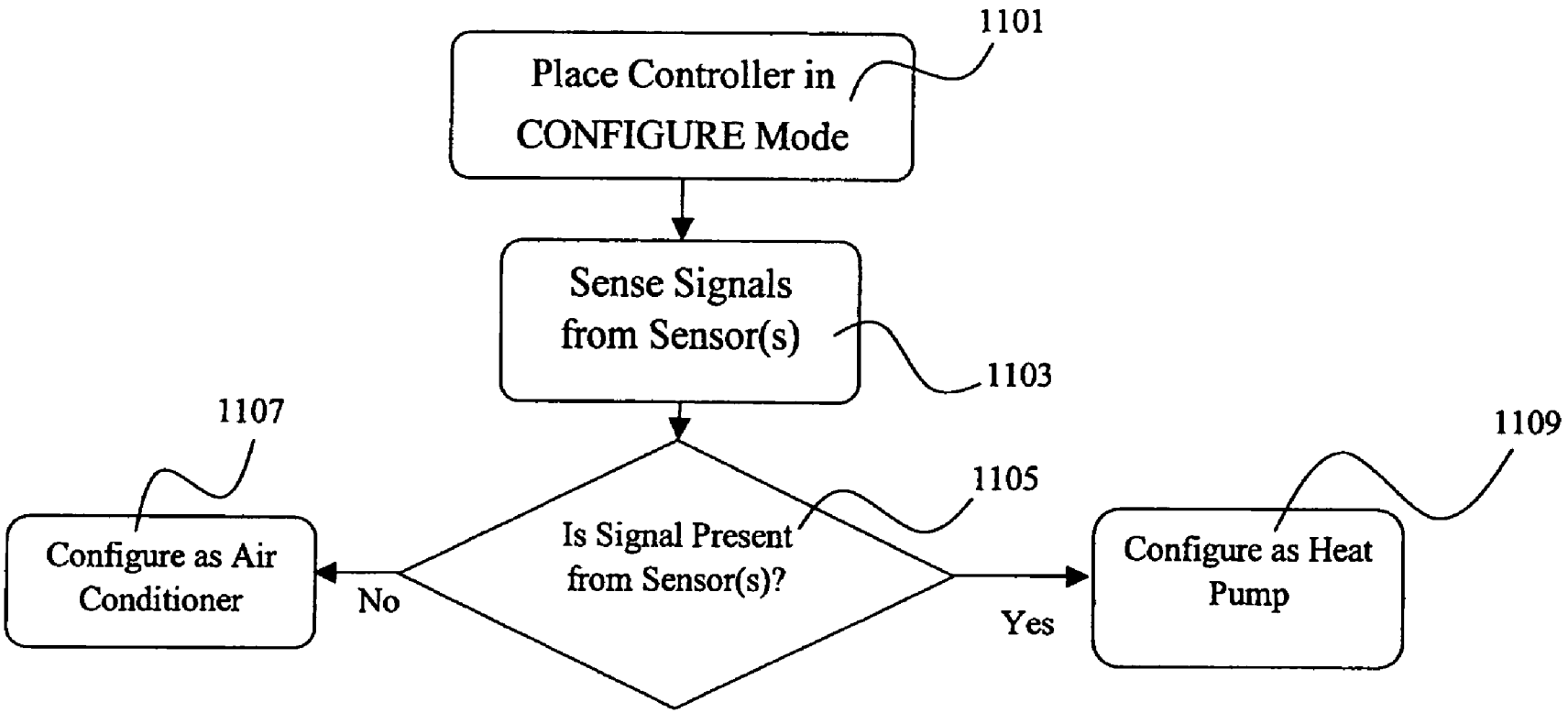
FIG. 11 illustrates a control method according to an alternate embodiment of the present invention.

FIG. 11 shows a method according to the present invention, corresponding to the systems shown in FIG. 6. The signals from the sensors are monitored in step 1103. In determination step 1105, signal sensor input "$S_{T1}$", "$S_{T2}$" and/or "$S_{T3}$" are transmitted to the processor 405. Signal sensor input "$S_{T1}$" is transmitted to the processor 405 through signal sensor line 608 and it is determined whether there is a signal present on line 607 (i.e., the output line from T1 Sensor). Signal sensor input "$S_{T2}$" is transmitted to the processor 405 through signal sensor line 610 and it is determined whether there is a signal present on line 609 (i.e., the output line from T2 Sensor). Signal sensor input "$S_{T3}$" is transmitted to the processor 405 through signal sensor line 612 and it is determined whether there is a signal present on line 611 (i.e., the output line from T3 Sensor). If step 1105 determines that no signal is present on the lines sensed (i.e., sensor output lines 607, 608 and 611), the controller configures itself as an air conditioner system 100 in step 1107. If signal sensor inputs "$S_{T1}$", "$S_{T2}$", and "$S_{T3}$" each show a signal on line 407, the method may proceed to step 1109, where the controller 401 is configured as a heat pump system 200.

Although FIG. 11 is shown as including sensor inputs from each of T1 Sensor 601, T2 Sensor 603 and T3 Sensor 605, the method may use any combination of one or more sensors that are unique to the heat pump system 200. The use of more than one sensor input may provide a means to determine wiring faults, wherein a wiring fault would be present if sensor inputs sense a signal on one or two of the three sensors shown in FIG. 6. The processor would return a wiring fault in this embodiment because each of the T1 Sensor 601, T2 Sensor 603 and the T3 Sensor are connected to controller 401 and are used in the operation of the heat pump system 200.

Although each of the methods shown in FIGS. 10-11 take place when the system is placed in CONFIGURE mode, the sensing of the loads can also take place when the controls are first powered up, when a thermostat call is first applied, or continually.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for configuring a controller for a closed loop refrigerant system comprising:
- providing a control system to control the closed loop refrigerant system, the control system comprising:
  - an input device comprising a plurality of input lines;
  - a controller configured to receive a plurality of input signals from the plurality of input lines of the input device, the controller comprising a plurality of output lines electrically connected to a plurality of components of the closed loop refrigerant system; and
  - a processor functionally separate from the controller in communication with the controller, the processor comprising a signal sensing circuit, the signal sensing circuit comprising a plurality of load sensor lines connected to the plurality of input lines of the input device, the plurality of load sensor lines providing an input to the processor from the plurality of input lines;
- executing a configuration mode for the controller, the configuration mode comprising:
  - activating the input device to provide at least one signal to the controller to instruct the controller to control at least one of the components of the closed loop refrigerant system;
  - sensing whether one or more signals are present on the plurality of input lines between the input device and the controller with the plurality of load sensor lines;
  - determining the type of closed loop refrigerant system with the processor using the sensed signals from the plurality of load sensor lines; and
  - sending a signal from the processor to the controller with the determined type of closed loop refrigerant system; and
- configuring the controller to provide control signals to the plurality of components of the closed loop refrigerant system based on the determined type of closed loop refrigerant system in the signal from the processor.

2. The method of claim 1, wherein the input device is a thermostat.

3. The method of claim 1, wherein the closed loop refrigerant system is selected from the group consisting of an air conditioning system and a heat pump system.

4. The method of claim 3, wherein the step of activating the input device includes providing a plurality of signals over the plurality of input lines to the controller during the activating step, wherein at least one input line of the plurality of input lines is used only in a heat pump system.

5. The method of claim 4, wherein determining the type of closed loop refrigerant system comprises determining a heat pump system is present in response to the plurality of load sensor lines sensing the presence of one or more signals on the at least one input line of the plurality of input lines.

6. The method of claim 5, wherein determining the type of closed loop refrigerant system comprises determining an air conditioning system is present in response to the plurality of load sensor lines sensing an absence of signals on the at least one input line of the plurality of input lines.

7. The method of claim 1, wherein determining the type of closed loop refrigerant system comprises determining a wiring fault is present in the closed loop refrigerant system in response to the sensed signals from the plurality of load sensor lines indicating neither an air conditioner system nor a heat pump system is present.

8. An HVAC system comprising:

an evaporator, a condenser, and a compressor in a closed loop refrigerant system, the closed loop refrigerant system also comprising a reversing valve when the closed loop refrigerant system is a heat pump; and a control system to control the closed loop refrigerant system comprising:

a controller adapted to receive a plurality of input signals from an input device, wherein the controller comprises a plurality of output lines electrically connected to a plurality of HVAC components in the closed loop refrigerant system;

a plurality of sensor output lines connected to the controller, the plurality of sensor output lines being connectable to a plurality of sensor units;

a processor functionally separate from the controller in communication with the controller, the processor including a signal sensing circuit, wherein the signal sensing circuit includes a plurality of load sensing lines connected to each sensor output line of the plurality of sensor output lines, the plurality of load sensor lines providing an input to the processor from the plurality of sensor output lines;

the processor being able to sense whether one or more signals is present on the plurality of sensor output lines with the plurality of load sensing lines, wherein the processor is configured to determine what type of closed loop refrigerant system is present based on the sensed signals from the plurality of sensor output lines; and the controller being configured to control the closed loop refrigerant system in response to the type of closed loop refrigerant system determined by the processor.

9. The system of claim 8, wherein the processor is configured to determine the presence of an air conditioning system in response to sensing no signals on the plurality of sensor output lines and the processor is configured to determine the presence of a heat pump system in response to sensing at least one signal on the plurality of sensor output lines.

10. The system of claim 8, wherein the input device is configured to provide one or more signals to the controller to control at least one component in the closed loop refrigerant system.

11. The system of claim 10, wherein the input device is a thermostat.

12. The system of claim 8, wherein the plurality of sensor units comprises a plurality of temperature sensors and the plurality of temperature sensors being configured and positioned to measure at least one of an outdoor ambient temperature, a compressor discharge temperature or a liquid line coil temperature.

13. The system of claim 8, wherein the processor and controller are integrated into a single component.

14. A control system to control a closed loop refrigerant system incorporating an evaporator, a condenser, and a compressor, the control system comprising:

a controller comprising a plurality of input lines adapted to receive a plurality of input signals from an input device and a plurality of output lines electrically connected to a plurality of components in the closed loop refrigerant system;

a signal sensing circuit, the signal sensing circuit comprising a plurality of load sensing lines connected to one of the plurality of input lines or the plurality of output lines;

a processor functionally separate from the controller in communication with the controller, the processor being connected to the plurality of load sensing lines to sense whether one or more signals is present on the plurality of load sensing lines, the plurality of load sensor lines providing an input to the processor from the one of the plurality of input lines or the plurality of output lines the processor is configured to determine whether an air conditioning system or heat pump system is present based on the sensed signals on the plurality of load sensing lines; and the controller being configured to control operation of the closed loop refrigerant system in response to the type of closed loop refrigerant system determined by the processor.

15. The control system of claim 14 wherein the processor and controller are integrated into a single component.

16. The control system of claim 14 wherein the processor is configured to determine a wiring fault is present in the closed loop refrigerant system in response to the sensed signals on the plurality of load sensor lines indicating neither an air conditioner system nor a heat pump system is present.

17. The control system of claim 14 wherein the plurality of load sensing lines are configured to sense a presence or absence of an electrical signal.

* * * * *